United States Patent [19]

DoMinh

[11] 4,318,977

[45] Mar. 9, 1982

[54] COBALT (III) COMPLEX IMAGING COMPOSITIONS HAVING IMPROVED PHOTOGRAPHIC PROPERTIES

[75] Inventor: Thap DoMinh, Rochester, N.Y.

[73] Assignee: Eastman Kodak Company, Rochester, N.Y.

[21] Appl. No.: 237,171

[22] Filed: Feb. 23, 1981

Related U.S. Application Data

[63] Continuation of Ser. No. 87,190, Oct. 22, 1979, abandoned.

[51] Int. Cl.[3] ..... G03C 1/52

[52] U.S. Cl. ..... 430/336; 430/341; 430/936

[58] Field of Search ..... 430/336, 341, 338, 936

[56] References Cited

U.S. PATENT DOCUMENTS

| | | | |
|---|---|---|---|
| 3,102,811 | 9/1963 | Barney | 430/495 |
| 3,630,735 | 12/1971 | Itano et al. | 430/337 |
| 3,708,297 | 1/1973 | Poot et al. | 430/343 |
| 3,874,946 | 4/1975 | Costa et al. | 430/370 |

FOREIGN PATENT DOCUMENTS 53-129028 11/1978 Japan .

OTHER PUBLICATIONS

Adin, Inhibiting Image Formation with Co(III) Complexes, Publication No. 79/00448, Jul. 1979, Internation Application Published under PCT, pp. 1–62.

*Research Disclosure,* No. 12617, Oct. 1974.

*Research Disclosure,* No. 13505, Jul. 1975.

*Research Disclosure,* No. 15874, Jun. 1977.

*J. Organic Chemistry,* vol. 29, p. 1527, (1964).

*Research Disclosure,* No. 14614, Jun. 1976.

*Research Disclosure,* No. 14719, Jul. 1976.

*Primary Examiner*—Won H. Louie, Jr.

*Attorney, Agent, or Firm*—Dana M. Schmidt

[57] ABSTRACT

There is disclosed an image-forming composition and element comprising a cobalt(III) complex containing amine ligands, an aromatic dialdehyde which forms, in the presence of reduction products of the complex, a reducing agent for the complex, and an organic oxidizing agent to improve the image properties of the composition.

11 Claims, No Drawings

COBALT (III) COMPLEX IMAGING COMPOSITIONS HAVING IMPROVED PHOTOGRAPHIC PROPERTIES

This is a continuation of application Ser. No. 087,190, filed Oct. 22, 1979, now abandoned.

FIELD OF THE INVENTION

This invention relates to an image-forming composition and element featuring the reduction of a cobalt(III) complex in response to activating radiation to produce an image having an internal gain.

BACKGROUND OF THE INVENTION

Considerable effort has been made to develop imaging compositions, particularly those useful in the graphic arts, which do not require the use of silver. The reason, of course, is the high cost of silver. One such nonsilver system involves the use of cobalt(III) complexes which are reduced as a result of a photolytic reaction to form as reaction products cobalt(II) and a released ligand, such as ammonia. Either of these can in turn be used to form images, the cobalt(II) being chelated by compounds capable of forming tridentate chelates, or the ammonia or other ligand being reacted with dye precursors, including diazo-coupler systems, to form a dye; or they can be used to bleach out preincorporated dye. Such compositions are disclosed in *Research Disclosure,* Vol 126, October, 1974, Publication No. 12617, Part III, published by Industrial Opportunities Limited, Homewell, Havant Hampshire P091EF, United Kingdom. Amplification can be achieved by using a reducing agent precursor capable of producing internal gain by forming with the aforesaid reduction products a reducing agent for the reduction of remaining cobalt(III) complexes. For example, certain of said chelating compounds for cobalt(II) form when chelated a reducing agent, as described in *Research Disclosure,* Vol 135, July, 1975, Publication No 13505. Alternatively, o-phthalaldehyde will react with ammonia to form a reducing agent, as disclosed in *Research Disclosure,* Vol 158, June, 1977, Publication No 15874.

All such compositions feature the release of ligands, preferably amines. Quite often, however, the ligand release, particularly when amplified by the mechanisms noted above, has been discovered so effective in forming images that excessive contrast can occur. As a result, these compositions often exhibit very short processing latitude over time or temperature, or short exposure latitude such as when reproducing halftone dots. Although these processing and exposure latitude characteristics are useful in certain cases, particularly when photographing line copy, they can be undesirable in other applications, such as in the reproduction of continuous tone images, where extended processing and exposure latitude are advantageous.

Therefore, there has been a need to modify the cobalt(III) complex imaging compositions in a manner that will provide an imaging composition and element having improved photographic properties.

It has been known that halogenated methyl-s-triazines will react with ammonia, as noted by Schaeffer and Ross, "Chlorination and Bromination of Alkyl-s-Triazines", *J Organic Chemistry,* Vol 29, page 1527 (1964). However, there is no suggestion in this article that such a reaction can control photographic properties, or indeed that this reaction has any relation to recognized image-forming chemistry.

Related Applications

Commonly owned U.S. Application Ser. No. 971,460, filed Dec. 20, 1978, by A. Adin and entitled "Inhibition of Imaging Formation Utilizing Cobalt(III) Complexes" describes trichloro-substituted chromophore-substituted s-triazines in combination with phthalaldehyde and cobalt(III) complexes.

Commonly owned U.S. Application Ser. No. 087,191, entitled "Cobalt(III) Complex Imaging Compositions Having Improved Photographic Properties" and co-filed with this application by A. Adin discloses and claims the use of oxidizing agents with reducing agent precursors for cobalt(III) complexes, such as chelating compounds.

SUMMARY OF THE INVENTION

In accordance with the present invention, there is advantageously provided an imaging composition and element utilizing cobalt(III) complexes and having improved photographic properties that correct the deficiencies noted above.

In a related feature of the invention there is provided such a composition and element which not only use aromatic dialdehyde reducing agent precursors to amplify the cobalt(III) reduction, but also have improved processing latitude and/or required contrast.

The aforesaid features of the invention arise from the discovery that organic oxidizing agents are capable of improving certain photographic properties of cobalt(III) complex-containing imaging compositions. More specifically, there is provided a light-sensitive image-forming composition, comprising in admixture (a) a reducible cobalt(III) complex containing amine ligands; (b) an aromatic dialdehyde which forms, in the presence of amines, a reducing agent for the cobalt(III) complex; and (c) an organic oxidizing agent.

The composition of the invention provides an improved imaging process comprising the steps of imagewise exposing the above-noted element to activating radiation, and developing the image formed.

Other features of the invention will become apparent upon reference to the following Description of the Preferred Embodiments.

DESCRIPTION OF THE PREFERRED EMBODIMENTS

High speed cobalt(III) complex imaging chemistry typically employs a reducing agent precursor included to amplify the reduction of the cobalt(III) complex. The precursor of this invention is any aromatic dialdehyde capable of producing in the presence of amines a reducing agent for the cobalt(III) complex. However, such dialdehydes produce photographic effects that can be less than satisfactory. To minimize these photographic effects, an organic oxidizing agent discussed hereinafter, is added.

Cobalt(III) complexes capable of undergoing a reduction reaction to release their ligands are fully described in the literature. Any cobalt(III) complex containing releasable amine ligands and which is thermally stable at room temperature will function in this invention. Such complexes on occasion have been described as being "inert". See, e.g., U.S. Pat. No. 3,862,842, Columns 5 and 6. However, the ability of such complexes to remain stable, i.e., retain their original ligands when stored by themselves or in a neutral solution at room temperature until a chemically or thermally initiated reduction to cobalt(II) takes place, is so well known that the term "inert" will not be applied herein.

Such cobalt(III) complexes feature a molecule having a cobalt atom or ion surrounded by a group of atoms or other molecules which are generically referred to as ligands. The cobalt atom or ion in the center of these complexes is a Lewis acid while the ligands, herein described as amine ligands, are Lewis bases. While it is known that cobalt is capable of forming complexes in both its divalent and trivalent forms, trivalent cobalt complexes—i.e., cobalt(III) complexes—are employed in the practice of this invention, since the ligands are relatively tenaciously held in these complexes, and released when the cobalt is reduced to the (II) state.

Preferred cobalt(III) complexes useful in the practice of this invention are those having a coordination number of 6. A wide variety of amine ligands can be used with cobalt(III) to form a cobalt(III) complex, including, e.g., methylamine, ethylamine, ammines, and amino acids such as glycinato. As used herein, "ammine" refers to ammonia specifically, when functioning as a ligand, whereas "amine" is used to indicate the broader class noted above. Highly useful with any of the destabilizer materials hereinafter described are the ammine complexes. The other amine complexes achieve best results when used with photoreductant destabilizers as described hereinafter.

The cobalt(III) complexes useful in the practice of this invention can be neutral compounds which are entirely free of either anions or cations. As used herein, "anion" refers to a charged species which, in the commonly understood sense of the term, does not include species that are covalently bonded. The cobalt(III) complexes can also include one or more cations and anions as determined by the charge neutralization rule. Useful cations are those which produce readily soluble cobalt(III) complexes, such as alkali metals and quaternary ammonium cations.

A wide variety of anions can be used. For example, the anion(s) can be $$Q'_p—C_nH_m—CO_2^{\ominus} \quad (a)$$

wherein n is an integer of from 0 to 20, m and p are each individually an integer of from 0 to 41, provided that if n and m are zero, then p is zero; and Q' is alkoxy, alkyl, thio, hydroxy, carboxamido, sulfonamido, sulfonyl, sulfamyl, phosphonate, phosphinate, sulfato, carbonato, carbamato, carbonyl to form pyruvate, aryl or substituted aryl, —O—, or an electron-withdrawing group such as halogen, azide, cyanate, or thiocyanate; e.g., any perfluorocarboxylate or fully halogenated alkyl carboxylate;

$$C_nH_m—Q'_pSO_3^{\ominus} \quad (b)$$

wherein n, m, p and Q' have the same meaning as described above, to form, for example, trifluoromethane sulfonate or $SO_3^{\ominus}$;

$$Q^2Q^3PO_4^{\ominus} \quad (c)$$

wherein $Q^2$ and $Q^3$ are each independently aryl, alkyl, or substituted aryl or alkyl;

$$MQ^4 \quad (d)$$

wherein M is a group VA element other than nitrogen and $Q^4$ is halogen;

$$Q^2—SO_2N^{\ominus}SO_2Q^3 \quad (e)$$

wherein $Q^2$ and $Q^3$ are as defined above; and

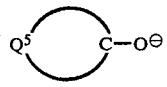

(f)

wherein $Q^5$ is the atoms necessary to form an aromatic or heterocyclic ring.

Further details concerning the cobalt(III) complexes are recited in *Research Disclosure,* Vol. 126, Publication No. 12617, October 1974, Part III thereof, the details of which are expressly incorporated herein by reference.

The following Table I is a partial list of particularly preferred cobalt(III) complexes useful in the invention.

TABLE I hexa-ammine cobalt(III) benzilate
hexa-ammine cobalt(III) perfluorobenzoate
hexa-ammine cobalt(III) thiocyanate
hexa-ammine cobalt(III) trifluoromethane sulfonate
hexa-ammine cobalt(III) trifluoroacetate
hexa-ammine cobalt(III) heptafluorobutyrate
chloropenta-ammine cobalt(III) perchlorate
bromopenta-ammine cobalt(III) perchlorate
aquopenta-ammine cobalt(III) perchlorate
bis(methylamine) tetra-ammine cobalt(III) hexafluorophosphate
trinitrotris-ammine cobalt(III)
penta-ammine carbonate cobalt(III) perchlorate
tris(glycinato) cobalt(III)
tris(trimethylenediamine)cobalt(III) trifluoromethanesulfonate
tri(trimethylenediamine)cobalt(III) tetrafluoroborate
bis(ethylenediamine)bisazido cobalt(III) perchlorate
triethylenetetraaminedichloro cobalt(III) trifluoroacetate
aquopenta(methylamine) cobalt(III) nitrate
chloropenta(ethylamine) cobalt(III) pentafluorobutanoate
trinitrotris(methylamine) cobalt(III)
tris(ethylenediamine) cobalt(III) trifluoroacetate
bis(dimethylglyoxime)bispyridine cobalt(III) trichloroacetate
μ-superoxodecamine cobalt(III) perchlorate
trans-bis(ethylenediamine)chlorothiocyanato cobalt(III) perchlorate
trans-bis(ethylenediamine)bisazido cobalt(III) thiocyanate
cis-bis(ethylenediamine)ammineazido cobalt(III) trifluoroacetate
tris(ethylenediamine) cobalt(III) benzilate
trans-bis(ethylenediamine)dichloro cobalt(III) perchlorate
bis(ethylenediamine)dithiocyanato cobalt(III) perfluorobenzoate
triethylenetetraaminedinitro cobalt(III) dichloroacetate
tris(ethylenediamine)cobalt(III) succinate
tris(2,2'-bipyridyl)cobalt(III) perchlorate
bis(dimethylglyoxime)chloropyridine cobalt(III) and
bis(dimethylglyoxime)thiocyanatopyridine cobalt(III).

The cobalt(III) complexes described above are themselves responsive to UV radiation, i.e., radiation of wavelengths less than 350 nm. In addition to exposure to such radiation, a destabilizer material can be added which causes release of the ligands from the complex upon appropriate exposure. Such destabilizers include 4-phenyl catechol, sulfonamidophenols and naphthols, cyclic acids such as phthalamic acid, ureas, amine salts, morpholine precursors, aminimides, triazoles, thiolate precursors, blocked mercaptotetrazoles, cyclic imides, barbituates, polymers containing pendant polysulfonamide moieties, and light-responsive photoactivators responsive to wavelengths greater than 350 nm. Further description and detailed lists of such destabilizers can be found in "Inhibition of Image Formation Utilizing Cobalt(III) Complexes", *Research Disclosure,* Vol. 184, August 1979, Publication No. 18436, the contents of which are expressly incorporated herein by reference.

Preferred examples of such photoactivators are photoreductant destabilizers, and particularly quinone photoreductants. The quinones which are particularly useful as photoreductants include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresponding reducing agent. A variety of such substituents are known to the art and include, but are not limited to, primary, secondary and tertiary alkyl, alkenyl and alkynyl, aryl, alkoxy, aryloxy, alkoxyalkyl, acyloxyalkyl, aryloxyalkyl, aroyloxyalkyl, aryloxyalkoxy, alkylcarbonyl, carboxy, primary and secondary amino, aminoalkyl, amidoalkyl, anilino, piperindino, pyrrolidino, morpholino, nitro, halide and other similar substituents. Aryl substituents are preferably phenyl substituents. Alkyl, alkenyl and alkynyl substituents, whether present as sole substituents or present in combination with other atoms, typically contain about 20 or fewer (preferably 6 or fewer) carbon atoms.

A preferred class of photoreductants are internal hydrogen source quinones; that is, quinones incorporating labile hydrogen atoms. These quinones are more easily photoreduced than quinones which do not incorporate labile hydrogen atoms.

Further details and a list of useful quinone photoreductants of the type described above are set forth in *Research Disclosure,* Volume 126, October 1974, Publication No. 12617, published by Industrical Opportunities Limited, Homewell, Havant Hampshire PO91EF, United Kingdom, the contents of which are hereby expressly incorporated by reference. Still others which can be used include 2-isopropoxy-3chloro-1,4-naphthoquinone and 2-isopropoxy-1,4-anthraquinone.

The aromatic dialdehyde of the invention is a reducing agent precursor in that it reacts to form, in the presence of amines, a reducing agent for the cobalt(III) complex. Any such dialdehyde can be used.

o-Phthalaldehyde, hereinafter phthalaldehyde, is the currently preferred dialdehyde reducing agent precursor of this invention. Phthalaldehyde appears to undergo the following reaction, in the presence of the released amines, to provide amplification in the exposed areas as well as a dye (B):

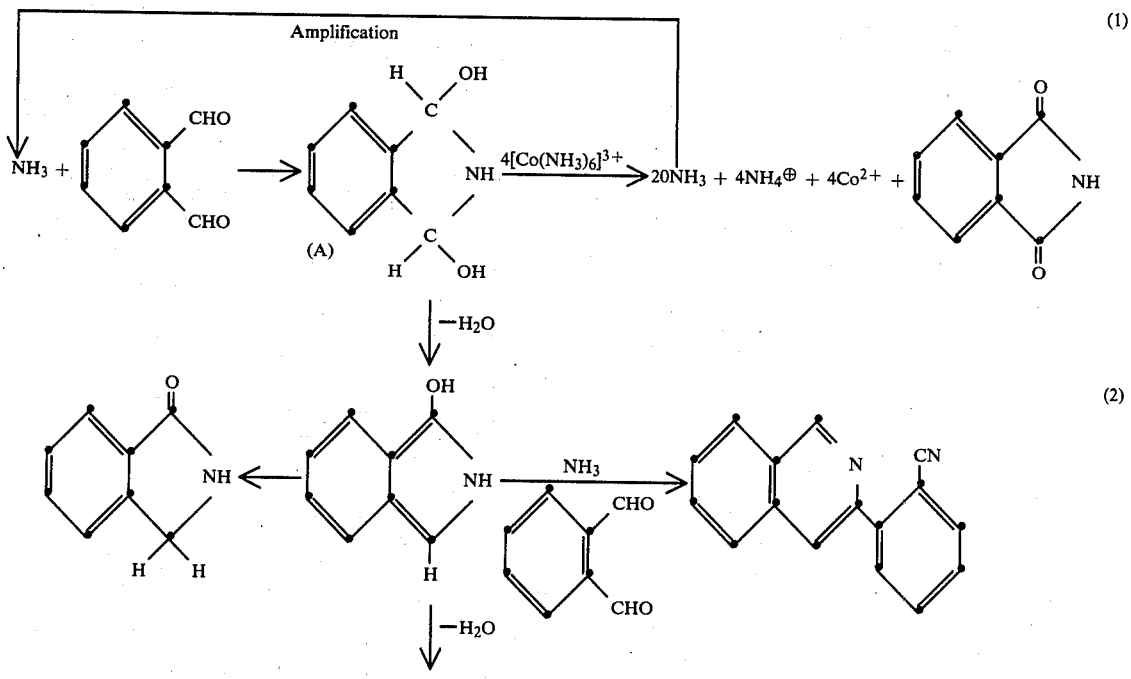

-continued (B)

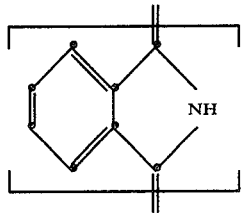

(3)

Further details of the phthalaldehyde reaction are set forth in DoMinh et al, "Reactions of Phthalaldehyde with Ammonia and Amines," *J. Org. Chem., Vol.* 42, Dec. 23, 1977, p. 4217.

When using phthalaldehyde as the reducing agent precursor, the contrast tends to be too high and processing latitude is reduced. It has been found that the organic oxidizing agents of the invention are useful in dealing with these problems.

Useful organic oxidizing agents can be selected from the following:

(I)

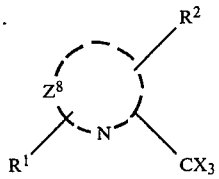

wherein $R^1$ and $R^2$ are same or different and are each $CX_3$, H, or $CH_3$; $Z^8$ represents the atoms necessary to complete one or more aromatic rings containing one or more hetero atoms, such as pyridyl, benzimidazolyl, benzothiazolyl, thiazolyl, and quinolinyl; and X is halogen such as bromine and chlorine;

(II)

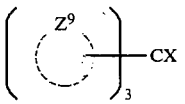

wherein $Z^9$ is the number of atoms necessary to complete an aryl ring, such as phenyl, and X is as defined above; and $$(R^4)_3C(CH_2)_n—SO_2—CX_3 \quad \text{(III)}$$

wherein n is an integer of from 0 to 4; $R^4$ is H or X, and X is as defined above; and (IV)

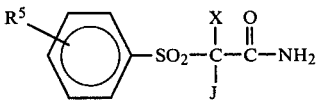

wherein $R^5$ is hydrogen or methyl, J is hydrogen or X, and X is as defined above.

A preferred form of the oxidizing agent of class (I) is (V)

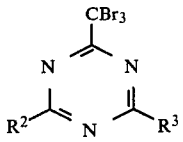

wherein $R^2$ and $R^3$ are the same or different and are each H, methyl or $CBr_3$. Thus, the currently preferred oxidizing agent is 2,4-bis(tribromomethyl)-6-methyl-s-triazine.

Although the exact mechanism by which these agents improve the photographic properties is not completely understood, it is believed it is one of oxidation. For example, in the case of 2,4-bis(tribromomethyl)-6-methyl-s-triazine as the oxidizing agent, it is believed the reaction proceeds as follows:

(4)

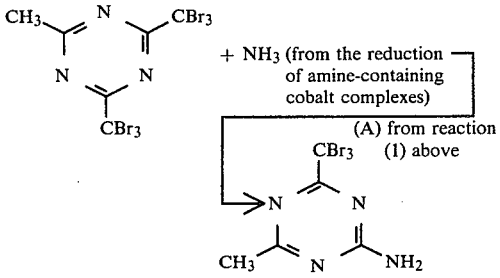

Further details of reactions such as (4) above are described in F. Schaeffer et al, *J. Org. Chem.,* Vol. 29, p. 1527 (1964).

Certain materials can be added as optional ingredients. For example, if the composition is to be coated as a film on a support, as opposed to being sprayed into filter paper, a binder is desirable. Any binder compatible with cobalt(III) complexes can be used, for example, the binders listed in the aforesaid Publication No. 12617 of *Research Disclosure,* especially paragraph I(D), the details of which are expressly incorporated herein by reference. Typical of such binders are acetates, cellulose compounds, vinyl polymers, polyacrylates and polyesters. In addition, the binder can be selected to maximize the maximum neutral densities produced during exposure and development. Highly preferred examples of such binders include certain polysulfonamides, for example, poly(ethylene-co-1,4-cyclohexylenedimethylene-1-methyl-2,4-benzenedisulfonamide), poly(ethylene-co-hexamethylene-1-methyl-2,4-benzenedisulfonamide), and poly(methacrylonitrile).

Yet other optional ingredients include additional materials for forming a detectable product in the imagewise-exposed areas beyond the optically dense cobalt(III) chelate. A preferred form of such additional discriminating materials is one which will form a polymer, and preferably an inkable polymer such as can be used to provide a lithographic printing plate. Particularly useful polymers are polyaldehydes capable of being cross-linked by amines to form a photohardened layer. Most preferred examples of such polyaldehydes are those described in *Research Disclosure,* Vol. 181, Publication No. 18183, (May 1979), the details of which are expressly incorporated herein by reference, e.g., a polymer having recurring units with the structure

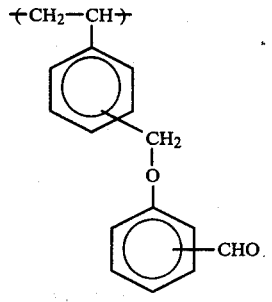

Still another, optional material is an amine-responsive image-recording layer of the type described in the aforesaid *Research Disclosure* Publication No. 13505, Paragraph V(K).

If the image-forming composition is to be coated on a support to form an element, any of the supports listed in the aforesaid *Research Disclosures,* Publications 12617 or 13505 can be used, e.g., poly(ethylene terephthalate) film.

The coating solvent selected will, of course, depend upon the makeup of the composition, including the binder, if any. Typical preferred solvents which can be used alone or in combination are lower alkanols, such as methanol, ethanol, isopropanol, t-butanol and the like; ketones, such as methylethyl ketone, acetone and the like; water; ethers, such as tetrahydrofuran, and the like; acetonitrile dimethyl sulfoxide and dimethylformamide.

The proportions of the non-binder reactants forming the composition and/or the imaging element can vary widely, depending upon which materials are being used. Since in any event, cobalt(III) complex is present, the molar amounts are expressed per mole of complex. The amount of the oxidizing agent that is to be added depends in part upon the desired photographic effect. Such amount of the oxidizing agent can be between about 0.07 moles per mole of cobalt(III) complex and about 0.17 moles per mole.

A convenient range of coating coverage of cobalt(III) complex is between about 5 and about 50 mg/dm$^2$.

Typically, solutions are coated onto the support by such means as whirler coating, brushing, doctor-blade coating, hopper coating and the like. Thereafter, the solvent is evaporated. Other exemplary coating procedures are set forth in the *Product Licensing Index,* Volume 92, December 1971, Publication No. 9232, at page 109, published by Industrical Opportunities Limited, Homewell, Havant Hamsphire PO91EF, United Kingdom. Addenda such as coating aids and plasticizers can be incorporated into the coating composition.

In certain instances, an overcoat for the radiation-sensitive layer of the element can supply improved handling characteristics and can help to retain otherwise volatile components. Useful examples include gelatin overcoats cross-linked with an agent, such as 5-weight percent aqueous solution of hexamethoxymethyl melamine, and various acrylamide-containing copolymers.

The image-forming composition described above, preferably as a coated element, is exposed imagewise to a suitable light source, for example an IBM Microcopier IID, and the development of the image is completed in a rapid manner by heating the element to a temperature of between about 100° and about 160° C., for a time of between about 1 and about 30 seconds. In such a heating process, the oxidizing agents of the invention serve to increase the available exposure and processing latitude of the element. One convenient measure of such exposure latitudes is the contrast control available to the composition. To the extent the composition has a reduced contrast, the greater is the latitude in exposure that is available over usual density values. The preferred oxidizing agent of the invention demonstrates a marked reduction in the contrast that would result if the oxidizing agent were not included.

Another technique for measuring the effect of the oxidizing agent on exposure latitude is by determining the exposure range that will reproduce an integrated density of half-tone dots to a value that is 0.75 to 1.25 times that of the actual value of the original dot images. In other words, the oxidizing agents reduce the "image spread". The preferred oxidizing agent of the invention can provide such a half-tone dot reproduction over at least 0.3 log E exposure. When exposure latitude is measured by this technique, the amount of oxidizing agent that is required is generally less than is required for preferred contrast control.

The following examples are included for a further understanding of the invention.

EXAMPLES 1–7

To demonstrate contrast control using 2,4-bis(tribromomethyl)-6-methyl-s-triazine as the oxidizing agent, the dopes listed below were coated at approximately 100-micron wet thickness on subbed poly(ethylene terephthalate) film support on a 32° C. hot block, held there for one minute, and then heated for five additional minutes at 60° C. Where overcoated, a 4.3% aqueous solution of poly(acrylamide-co-N-vinyl-2-pyrrolidinone-co-2-acetoacetoxyethylmethacrylate), hereinafter AVPA, (50:45:5 monomer weight ratios) was coated in the same manner.

| | |
|---|---|
| Phthalaldehyde | 0.320 g |
| Hexa-ammine cobalt(III) trifluoroacetate | 0.200 g |
| 2-Isopropoxy-1,4-naphthoquinone (0.40 mmoles) | 0.0108 g |
| Poly(ethylene-co-1,4-cyclohexylenedimethylene-1-methyl-2,4-benzenedisulfonamide) | 1.90 g |
| 2,4-bis(tribromomethyl-6-methyl-s-triazine | See Table II |
| Dimethyl polyoxyalkylene ether copolymer surfactant available under the trademark "SF-1066" from General Electric | 0.040 g |
| Acetone | 7.6 g |

The sensitometry of the elements was determined from transparencies prepared by contact exposing the elements for eight seconds through a 0.3 log E silver step tablet in an IBM Microcopier IID exposing device (with a 400-watt medium pressure mercury arc lamp).

The image was developed by contacting the back of the film for five seconds to a 140° C. hot block.

Neutral densities of the black reversal images were determined, contrast ($\gamma$) was measured as the slope of the straight-line portion of the curve, and toe speed was measured as the number of visible steps. The results for examples containing increasing amounts of triazine, both with and without an AVPA overcoat, are tabulated in Table II:

TABLE II

| | | | No Overcoat | | | AVPA Overcoat | | |
|---|---|---|---|---|---|---|---|---|
| Example | mg Triazine | mmoles Triazine | Toe Speed | $D^N_{max}$ | $\gamma$ | Toe Speed | $D^N_{max}$ | $\gamma$ |
| Control | 0 | 0 | 6 | 2.49 | 2.9 | 6 | 2.49 | 3.0 |
| 1 | 0.239 | 0.00040 | 6 | 2.30 | 2.6 | 6 | 2.42 | 3.0 |
| 2 | 2.39 | 0.0040 | 6 | 2.21 | 2.4 | 6 | 2.32 | 2.6 |
| 3 | 2.98 | 0.0050 | 6 | 2.19 | 2.4 | 6 | 2.29 | 2.6 |
| 4 | 5.97 | 0.010 | 6 | 2.04 | 2.0 | 6 | 2.13 | 2.3 |
| 5 | 11.9 | 0.020 | 6 | 1.79 | 1.9 | 6 | 1.83 | 1.9 |
| 6 | 17.9 | 0.030 | 6 | 1.50 | 1.0 | 6 | 1.50 | 1.15 |
| 7 | 23.9 | 0.040 | 6 | 0.94 | 0.58 | 6 | 1.08 | 0.73 |

As shown in the above table, as the concentration of the triazine is increased, with or without an overcoat, the contrast of the element is decreased without loss of toe speed.

The invention has been described in detail with particular reference to certain preferred embodiments thereof, but it will be understood that variations and modifications can be effected within the spirit and scope of the invention.

What is claimed is:

1. A light-sensitive image-forming composition, comprising, in admixture, (a) a reducible cobalt(III) complex containing amine ligands;

(b) an aromatic dialdehyde which forms, in the presence of amines, a reducing agent for said cobalt(III) complex; and (c) as an organic oxidizing agent, an s-triazine in an amount sufficient to reduce the contrast of the composition, when imagewise exposed in layer form and developed by heat, below that obtained by imagewise exposing and heat-developing the same composition in layered form but without said oxidizing agent.

2. A composition as defined in claim 1, wherein said dialdehyde is phthalaldehyde.

3. A composition as defined in claim 1 or 2, wherein said oxidizing agent is a halogenated compound.

4. A composition as defined in claim 1 or 2, wherein said oxidizing agent has the structure

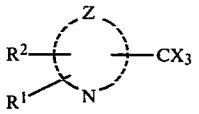

wherein $R^1$ and $R^2$ are same or different and are each $CX_3$, H, or $CH_3$;

X is halogen, and

Z is the number of atoms necessary to complete a s-triazine ring.

5. A composition as defined in claim 1 or 2, wherein said agent is 2,4-bis(tribromomethyl)-6-methyl-s-triazine.

6. An imaging element having improved processing latitude for a controlled image definition, comprising a support, and coated on the support, a light-sensitive image-forming composition, comprising, in admixture (a) a reducible cobalt(III) complex containing amine ligands;

(b) an aromatic dialdehyde which forms, in the presence of amines, a reducing agent for said cobalt(III) complex; and (c) as an organic oxidizing agent, an s-triazine in an amount sufficient to reduce the contrast of the composition, when imagewise exposed in layer form and developed by heat, below that obtained by imagewise exposing and heat-developing the same composition in layered form but without said oxidizing agent.

7. An element as defined in claim 6, wherein said dialdehyde is phthalaldehyde.

8. An element as defined in claim 6 or 7, wherein said oxidizing agent is a halogenated compound.

9. An element as defined in claim 6 or 7, wherein said ozidizing agent has the structure

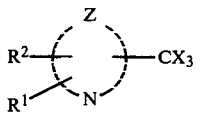

wherein $R^1$ and $R^2$ are same or different and are each $CX_3$, H, or $CH_3$;

X is halogen, and

Z is the number of atoms necessary to complete a s-triazine ring.

10. An element as defined in claim 6 or 7, wherein said agent is 2,4-bis(tribromomethyl)-6-methyl-s-triazine.

11. A method of forming an image, comprising the steps of:

(a) imagewise exposing to activating radiation a composition comprising, in layer form, a reducible cobalt(III) complex containing amine ligands; an aromatic dialdehyde which forms, in the presence of amines, a reducing agent for said cobalt(III) complex; and as an organic oxidizing agent, an s-triazine in an amount sufficient to reduce the contrast of the composition, when imagewise exposed in layer form and developed by heat, below that obtained by imagewise exposing and heat-developing the same composition in layered form but without said oxidizing agent; and (b) developing the image by heating said composition.

* * * * *